United States Patent [19]

Zipperian

[11] 4,394,258

[45] Jul. 19, 1983

[54] FROTH FLOTATION APPARATUS WITH WATER RECOVERY AND METHOD

[75] Inventor: Donald E. Zipperian, Tucson, Ariz.

[73] Assignee: The Diester Concentrator Co., Inc., Fort Wayne, Ind.

[21] Appl. No.: 276,809

[22] Filed: Jun. 25, 1981

[51] Int. Cl.[3] ..... B03D 1/24

[52] U.S. Cl. ..... 209/170; 209/501; 210/221.2

[58] Field of Search ..... 209/170, 168, 158–161, 209/501, 454, 1; 210/221.2

[56] References Cited

U.S. PATENT DOCUMENTS

| | | | |
|---|---|---|---|
| 1,869,241 | 7/1932 | Elie | 209/168 X |
| 3,371,779 | 3/1968 | Hollingsworth et al. | 209/170 X |
| 3,932,282 | 1/1976 | Ettelt | 210/221.2 X |
| 4,287,054 | 9/1981 | Hollingsworth | 209/170 |

*Primary Examiner*—Ralph J. Hill

*Attorney, Agent, or Firm*—Gust, Irish, Jeffers & Hoffman

[57] ABSTRACT

The invention relates to the concentration of particulate matter by froth flotation and in particular to improvements leading to the conservation of water. The apparatus includes an upstanding flotation compartment adapted to contain a relatively quiescent body of aqueous pulp. Aqueous pulp is introduced into and float fraction is collected from the upper portion of the flotation compartment, and hydraulic and aeration compartments are disposed near the bottom of the flotation compartment for aerating the water therein. A water-collecting compartment connected to the bottom of the hydraulic and aeration compartments is adapted to receive water from the latter. A tailings-discharge duct centrally of the flotation compartment extends through the hydraulic, aeration and water collection compartments to discharge fluidized tailings. The water-collecting compartment is connected to drain into a water-replenishing reservoir having an outlet leading to a pump which in turn is connected back to the hydraulic and aeration compartments. The reservoir is adapted to receive other water from a suitable source. Water draining from the water-collecting compartment is thereby recovered and recirculated back to the hydraulic and aeration compartments.

31 Claims, 5 Drawing Figures

FROTH FLOTATION APPARATUS WITH WATER RECOVERY AND METHOD

BACKGROUND OF THE INVENTION

1. Field of the Invention

The present invention relates to hydraulic-pneumatic flotation apparatus and method and more particularly to improvements for increasing efficiency of operation.

2. Description of the Prior Art

Commercially valuable minerals, for example, metal sulfides, apatitic phosphates and the like, are commonly found in nature mixed with relatively large quantities of gangue materials, and as a consequence it is usually necessary to beneficiate the ores in order to concentrate the mineral content thereof. Mixtures of finely divided mineral particles and finely divided gangue particles can be separated and a mineral concentrate obtained therefrom by well known froth flotation techniques. Broadly speaking, froth flotation involves conditioning an aqueous slurry or pulp of the mixture of mineral and gangue particles with one or more flotation reagents which will promote flotation of either the mineral or the gangue constitutents of the pulp when the pulp is aerated. The conditioned pulp is aerated by introducing into the pulp a plurality of minute air bubbles which tend to become attached either to the mineral particles or to the gangue particles of the pulp, thereby causing these particles to rise to the surface of the body of pulp and form thereat a float fraction which overflows or is withdrawn from the flotation apparatus.

Typical such flotation apparatus is disclosed in U.S. Pat. No. 3,371,779. In operation, the conditioned pulp is introduced into a flotation compartment containing a relatively quiescent body of an aqueous pulp, and aerated water is introduced into the lower portion of the flotation compartment through suitable orifices. A body of aerated water is provided in an aeration compartment disposed directly below the flotation compartment, a multitude of fine air bubbles being dispersed throughout the water therein. This body of aerated water is in fluid communication with the aqueous pulp in the lower portion of the flotation compartment through the aforementioned orifices. An overflow fraction containing floated particles of the pulp is withdrawn from the top of the flotation compartment and underflow or non-float fraction containing non-floated particles of the pulp is withdrawn from the lower portion of the flotation compartment.

This underflow includes water and non-float fraction. It is conventional to discharge this underflow to waste thereby resulting in the loss of the water. It is the recovery of this wasted water and chemicals which may be contained therein to which the present invention is directed.

Other prior art relating to the concentration of minerals by flotation is disclosed in Hollingsworth Application Ser. No. 145,130, filed May 5, 1980, now U.S. Pat. No. 4,287,054, and U.S. Pat. Nos. 2,753,045 and 3,298,519.

SUMMARY OF THE INVENTION

The apparatus of this invention includes a flotation compartment adapted to contain a relatively quiescent body of aqueous pulp. Pulp feed means introduces aqueous pulp into the flotation compartment, and froth overflow means disposed adjacent to the upper end of the flotation compartment receives the discharge of a float fraction containing floated particles of the aqueous pulp. Hydraulic and aeration compartments are disposed beneath the flotation compartment and are adapted to contain a body of water maintained at a higher static pressure than that of the aqueous pulp in the lower portion of the flotation compartment.

Means is provided for introducing air and water into the aeration and hydraulic compartments and for forming a multitude of air bubbles throughout the water in the flotation compartment, such means conventionally including an aspirating device but not being restricted thereto. Underflow means is provided for discharging the non-float fraction containing unfloated particles and water of the aqueous pulp from the flotation compartment.

A water-collecting or recovery compartment is mounted on the underside of the aeration compartment and receives water therefrom. This collected water is drained via a hydraulic line and control valves into a sump which may also be supplied with a controlled amount of external water. The outlet of the sump is connected by means of a pump to the aeration and hydraulic compartments for recirculating water from the water-collecting compartment back to the aeration and hydraulic compartments. By this means water and any chemical contained therein are recovered. The only water and chemical lost is that discharged with the non-float fraction as a part of the underflow.

Also, this invention comprehends the introduction of controlled amounts of plain water to the hydraulic compartment and aerated water to the aeration compartment thereby to obtain a balance between the fluidizing water and air bubbles supplied to the system, and to maintain a hydraulic seal by means of the hydraulic compartment between the flotation compartment and the aeration compartment to prevent solids from leaving the flotation compartment and entering the areation and water collecting compartments.

An object of this invention is to provide for improvements in the efficiency of concentrating ores by froth flotation.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE EMBODIMENTS

Figure 1:
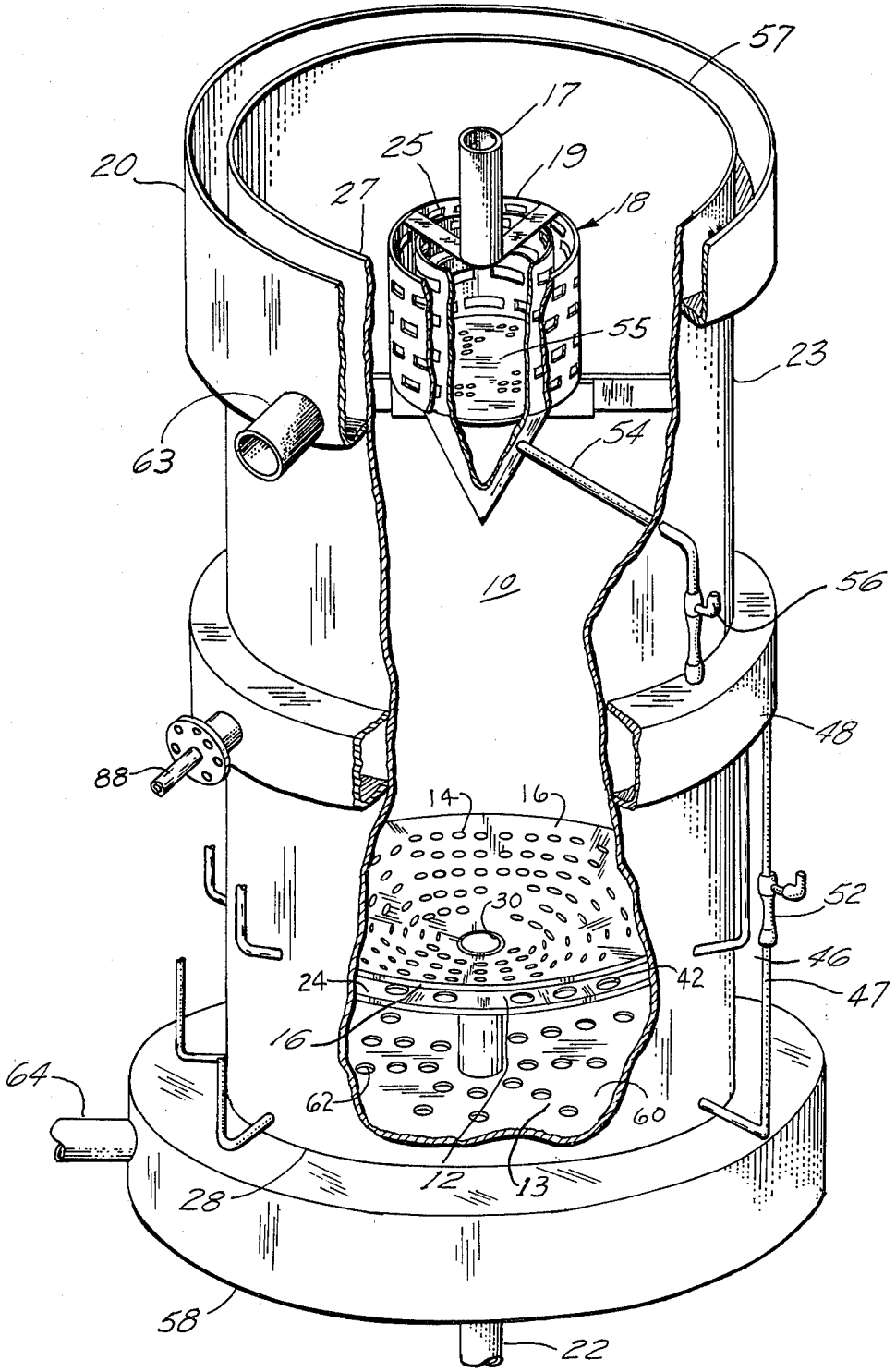
FIG. 1 is a perspective view partially broken away and sectioned for clarity of illustration of a portion of one embodiment of the present invention.
Figure 2:
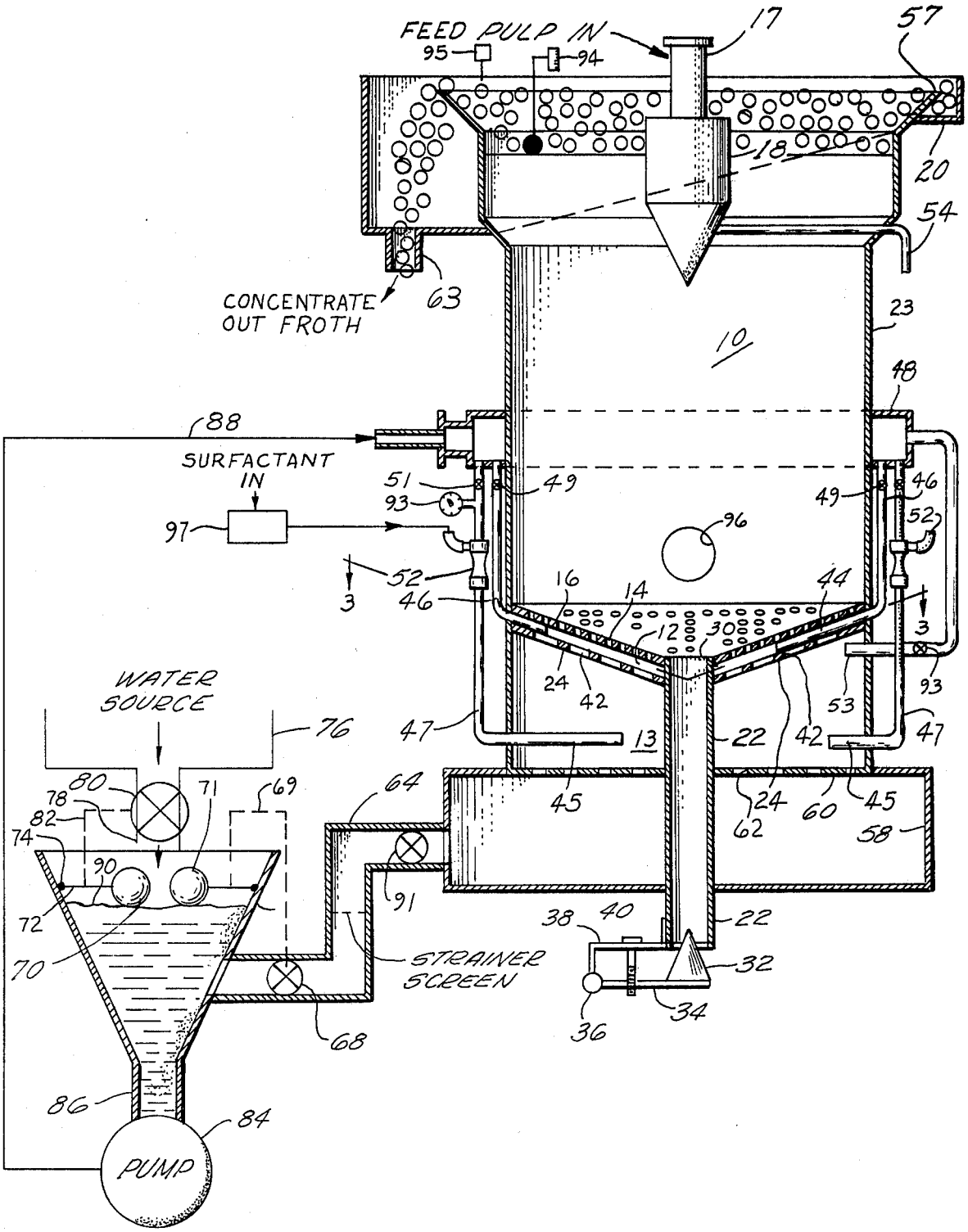
FIG. 2 is a longitudinal sectional view, in part diagrammatic, of the aforesaid embodiment.

Referring to FIG. 1 for a general description, the flotation apparatus comprises a flotation compartment 10 adapted to contain a body of aqueous pulp to be separated into float and non-float fractions, a hydraulic sealing compartment 12 and an aeration compartment 13 being disposed directly below the flotation compartment 10 and adapted to contain a body of aerated water containing tiny bubbles introduced into the flotation compartment through orifices 14 in the constriction plate 16 which serves as the bottom wall of the compartment 10. A pulp feed pipe 17 and an apertured pulp feed wall 18 are provided adjacent the upper end of the apparatus for introducing at a uniform rate of flow a conditioned aqueous pulp into the flotation compartment 10, and an apertured dispersion sleeve 19 coaxially surrounds the feed well 18. An annular, froth overflow launder 20 is provided adjacent to the upper end 57 of the flotation compartment 10 for withdrawing the float fraction therefrom. Low velocity underflow discharge means or pipe 22 is provided adjacent to the lower end of the flotation compartment 10 for withdrawing underflow or non-float material from the flotation compartment 10.

The flotation compartment 10 has a substantially circular cross-section defined by the cylindrical wall 23, the constriction plate 16, serving, as previously noted, as the bottom. The hydraulic sealing compartment 12 is defined at the top by the constriction plate 16, at the side by the cylindrical wall 23, and at the bottom by a second, apertured constriction plate 24 spaced below and extending parallel to the constriction plate 16. The plates 16 and 24 preferably are cone-shaped as shown but may be horizontally flat. They are parallel and closely spaced, for example, about two inches apart in a typical full-scale, working embodiment. The underflow discharge means 22 is in the form of a straight duct or pipe coaxially centered with respect to the wall 23 and sealingly secured at its upper end to and opening through the plates 16 and 24, such opening being indicated by the numeral 30. The plate 24 is sealingly secured to the outer periphery of the pipe 22 as shown. A cone-shaped valve 32 is disposed for movement within the lower end of the pipe 22 as shown, the valve 32 being mounted on a lever 34 pivoted at 36 to a bracket 38 secured to the lower end of the pipe 22. A screw adjustment 40 is received by the bracket 38 and threads into the lever 34, rotation of the screw 40 serving to move the valve 32 vertically. The valve 32 serves in controlling the rate of discharge of water and non-float fraction from the flotation compartment 10 to control the level of water therewithin. Depending upon design preferences, instead of the valve 32, a conventional, commercially available pinch valve may be used such as the 7300 and 7490 series manufactured by Flexible Valve Corporation, South Hackensack, New Jersey.

The apertures 14 in the constriction plate 16 are uniformly spaced, such as about one-eighth inch, and in one working embodiment are 5/32 inches in diameter spaced on $\frac{1}{2}$ inch centers. The plate 24 also is provided with apertures 42 larger than those of apertures 14 in plate 16, and in one working embodiment are $1\frac{1}{8}$ inches in diameter spaced on $1\frac{3}{8}$ inch centers.

Figure 3:
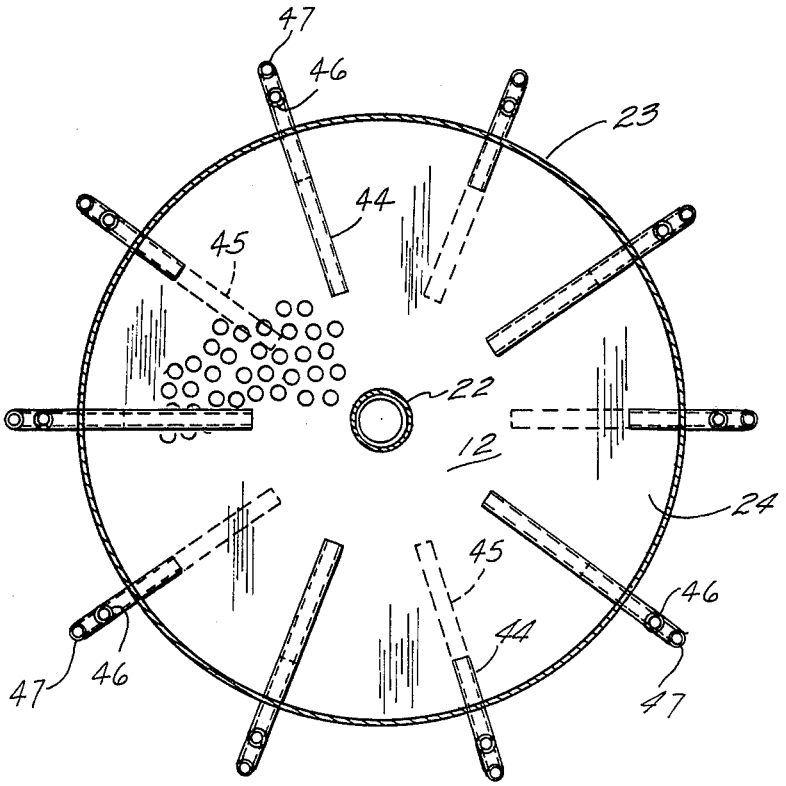
FIG. 3 is a cross-section through the hydraulic compartment and in particular is taken substantially along section line 3—3 of FIG. 2.

It is important that the hydraulic and aeration compartments 12 and 13 contain water maintained at a slightly higher pressure than that of the aqueous pulp in the flotation compartment 10. Accordingly, these compartments 12 and 13 are provided with means for introducing air and water thereinto and with means for forming a uniform dispersion of minute air bubbles throughout the water in the compartment 10. The purpose of the air and water introducing means as well as the air dispersing means is similar to the aeration means disclosed in U.S. Pat. No. 3,371,779, but as shown in the drawings, but structurally differs in part by the separate compartments 12 and 13 which have therein a series of circumferentially arranged, radial pipe extensions 44 and 45 (FIG. 3) of different lengths. These extentions 44 and 45 are connected to pipes 46 and 47 leading to an annular, water manifold 48 to which water at a pressure of, for example, 25 to 50 pounds per square inch may be connected. In series with each of the pipes 47 is a conventional aspirator 52. A typical aspirator is shown in the aforesaid U.S. Pat. No. 3,371,779.

Another pipe 54 is connected at one end to the manifold 48 and at the other end to the feed well 18. An aspirator 56 like the aspirator 52 is connected in series with the pipe 54.

In the operation of the apparatus described thus far, plain water and water with aspirated air are introduced into the hydraulic compartment 12 and aeration compartment 13, respectively, with the static pressure in both compartments 12 and 13 being above the static pressure of the aqueous pulp in the lower portion of the flotation compartment 10. Theoretically, the pressure differential between the water in the compartments 12 and 13 and the aqueous pulp in the lower portion of the flotation compartment 10 should not be permitted to fall below about 0.5 pounds per square inch, and preferably not below about 1 pound per square inch, in order to maintain the compartments 12 and 13 substantially free of aqueous pulp. A preferred operating range is from about 2 to 4 pounds per square inch. Actual adjustments are as explained later.

The rate of water input to the flotation compartment corresponds to the flow from discharge pipe 22, such that the level of liquid within compartment 10 is uniformly maintained at or just below the upper edge 57, or otherwise at a level at which float fraction with no or only minimal water overflows into launder 20.

Water flowing in the pipes 47 and 54 is mixed with air drawn from the surrounding atmosphere by means of the aspirators 52 and 56, respectively. The water flowing into the compartment 13 is thus aerated, bubbles from this aerated water flowing upwardly through the orifices 14, 42 in the constriction plates 16, 24 into the flotation compartment 10. The orifices 14, 42 receive therethrough a plurality of streams of uniformly aerated water. In this connection, it is important to note that the constriction plates 16, 24 are not primarily air diffusers and that the orifices 14, 42 are not intended to control the size of the air bubbles, the stream of water flowing through each orifice already being aerated with a multitude of minute, uniformly dispersed air bubbles. The orifices 14 and 42 are relatively large and are distributed in a relatively widely spaced geometric pattern across the entire area of the constriction plates in order to insure uniform distribution of the aerated water being introduced into the flotation compartment and, thereby to insure uniform aeration of the aqueous pulp in the flotation compartment.

To assure a proper balance between water and air being introduced into the flotation compartment 10 from compartments 12 and 13, pressurized, non-aerated water only is introduced into compartment 12 by means of pipes 46 and extensions 44. Each of the pipes 46 and 47 is provided with a manually operable valve 49 and 51, respectively, by means of which this balance may be adjusted. Sufficient pressurized water is introduced into hydraulic compartment 12 to provide a hydraulic seal between compartments 10 and 13. To assure adequate seal water, valves 49 are adjusted. Valves 51 are adjusted to provide sufficient aerated water as evidenced by the quantity of bubbles admitted to flotation compartment 10. When properly adjusted along with valve 32, the desired water level in compartment 10 will be maintained, descending pulp in compartment 10 will be inhibited from entering compartments 12 and 13, and a rising pattern of air bubbles within compartment 10 will be observed.

Generally speaking, the aqueous pulp to be separated, which includes water and feed is delivered at a suitable, preferably uniform rate into the feed well 18 where it encounters aerated water delivered thereto by the pipe 54, this aerated water passing upwardly through an apertured, constriction plate 55 therein to provide an aerated body of water which carries the floatable fractions upwardly and horizontally into the flotation compartment 10. The usual flotation chemicals such as reagents as disclosed in the aforesaid U.S. Pat. No. 3,371,779 are introduced into the feed well as desired by first being thoroughly mixed with the pulp feed before it is fed to the feed well 18.

More specifically, the wall of the feed well 18 is provided with apertures 21 either round or elongated, the latter being preferred, also, the dispersion sleeve 19 is provided with like apertures 27, sleeve 19 being mounted on the feed well 18 by means of bar-like braces 25. Aerated pulp not only flows upwardly out of the well 18 but also through apertures 21 and 27, there to encounter further aeration in the compartment 10.

The froth that forms on the upper surface of the aqueous pulp in the flotation compartment 10 contains the floatable particles from the aqueous pulp which overflows into the annular launder 20 and out of the float discharge pipe 63. The non-floatable particles entering the flotation compartment 10 gravitate downwardly to be discharged through the pipe 22. The rate of discharge of non-float residue and water is controlled by means of the valve 32. The floatable particles not captured and floated at the feed well as they settle through flotation compartment 10 are subjected to continuous floating action by the rising bubbles in the compartment 10. The pulp feed is thereby separated in the manner described in the aforesaid U.S. Pat. No. 3,371,779 into the desired and undesired constituents.

Secured to the bottom end of the wall 23 thereof is a water-collecting or recovery compartment 58. A plate 60 having relatively large apertures 62 like those in plate 24 and spaced throughout the extend thereof separates the compartment 13 from the compartment 58. The discharge pipe 22 extends through compartment 58 as shown with the periphery being sealed to the compartment walls to prevent leakage. A water outlet pipe 64 connects from the side of the water-collecting compartment 58 to a reservoir 66 as shown, an automatically adjustable flow control valve 68 (diagrammatically shown) and a manually controlled valve 91 being series connected with the pipe 64. These valves 68 and 91 regulate the rate of flow of water from the compartment 58 to the reservoir 66.

A first conventional valve-controlling float 70 is mounted within the reservoir 66 and is carried by an arm 72 pivotally conneted at 74 to the reservoir side as shown.

Immediately above the reservoir 66 is disposed a source 76 of fresh water having a drain 78 emptying into the reservoir 66. An "on-off" or flow control valve 80 (diagrammatically shown) is connected in series with the drain 78, a suitable, mechanical connection 82 being provided between arm 72 and the valve 80 for operating the latter between "on" and "off" positions. A similar float 71 operates valve 68 by means of a like connection 69.

A conventional water pump 84 is connected to the outlet 86 of the reservoir 66 and from there by means of the line 88 (diagrammatically shown) to the manifold or header 48.

As explained previously, floatable particles are carried to the top of the flotation compartment 10 where they become a part of the froth that overflows into the launder 20. The tailings composed of non-float fraction along with a quantity of water are discharged from the bottom end of the flotation compartment 10 via discharge duct 22. The other portion of the water admitted to compartment 10 flows downwardly through apertures 62 in plate 60 into water-collecting compartment 58. This water drains from the compartment 58 via the pipe 64 and the valves 68 and 91 into the reservoir 66 wherein it reaches a predetermined, controllably maintained level indicated by the numeral 90. The water within the reservoir 66 is pumped by means of the pump 84 and line 88 back to the manifold 48 from which it flows, as previously explained, via the lines 46 and 47 back into the compartments 12 and 13. The pump 84 is set to deliver such water under pressure of from 20 to 50 pounds per square inch. The aspirators 52 introduce air bubbles into this water flowing through pipes 47 such that the water within the compartments 12 and 13 is aerated as previously explained. Thus it is seen, that the water which is not discharged from the duct 22 is recovered and recirculated back to the compartments 12 and 13.

As stated previously, suitable chemicals may be fed to the system along with the aqueous pulp delivered to the feed well 18. Such chemicals may also be metered into one or more of the aspirators 52, surfactants being effectively added in this manner.

Water fed to the system is controlled in such a manner as to optimize the recovery of float fraction as overflow into the launder 20. According to one technique, this control is achieved by maintaining the water level constant within flotation compartment 10 at or a few inches below the peripheral lip 57. Once the system parameters are set, this level is maintained constant primarily by controlling the flow from discharge duct 22, the valve 32 being adjusted accordingly.

There are primarily two outside sources of water for the system, one being the water contained in the aqueous pulp fed to feed well 18 and the other being the make-up water supplied by source 76. Assuming a uniform quantity of water is being supplied with the aqueous pulp, the valve 32 is set to discharge a corresponding amount from duct 22. Should the pulp water reduce, the valve 32 should be adjusted to correspondingly restrict discharge. Should pulp water increase, valve 32 should correspondingly open. This modulation of valve 32 may be made sensitive to froth and water levels within compartment 10 by means of suitable conventional sensors 94 and 95 connected by means of suitable actuating means which controls valve 32 automatically. Such automatic control systems are conventional and may employ a pinch type valve as previously explained instead of the conical valve 32 shown. Also, the valve 32 may be manually controlled.

Initially, valves 68, 91 and 80 are adjusted for a given pulp water input and setting of valve 32 as explained, the valve 68 having a setting that assures an adequate supply of water to compartments 12 and 13. Valve 68 as controlled by float 71 and valve 91 are opened by an amount that maintains the level of water in reservoir 66 just above level 90. If this level drops, float 71 opens valve 68 enough to bring the level back up, valve 91 having previously been pre-set to accommodate this modulation. Since some water introduced into compartments 12 and 13 may flow upwardly through orifices 14 and eventually discharge through duct 22, additional water may be required and this is sensed by reason of a drop in level 90, float 70 operating valve 80 to provide make-up water to reservoir 66 until at least level 90 is reached. Thus, an adequate supply of water to the recirculating system 58, 64, 68, 84, 88, 48 and 12 is assured.

In some instances it may be desired to further dilute the pulp delivered to the feed well 18. This is accomplished by further fluidization within flotation compartment 10 by adding water from source 76 via reservoir 66. In this instance the valve 80 would be correspondingly adjusted to accommodate in ancillary supply from source 76 in an amount corresponding to the deficiency in the aqueous pulp feed to make up the total discharge from duct 22. While float 70 serves in maintaining level 90 within reservoir 66 automatically, valve 80 may be manually controlled for the purpose.

While the air bubbles, in the preferred embodiments disclosed, are obtained by aspirating the water externally of the aeration compartment 13, an alternative arrangement (not shown) is to develop bubbles in the aeration compartment using a conventional mechanically operated impeller-type air diffusor as disclosed in Hollingsworth Patent No. 3,371,779.

Preferred setting of the parameters may be obtained by observation of the pattern of air bubbles within compartment 10 through a glass or plastic window 96. The bubbles should be rising only and not swirling, rolling or otherwise moving in directions having horizontal and downward components. Under certain conditions, it may develop that this rising pattern cannot be continuously maintained. One solution to this problem is to introduce additional water into compartment 13 by means of a pipe 53 leading from header 48. A valve 93 in series with the pipe 53 along the valves 49 in pipes 46 may be conjointly adjusted to assure maintenance of the desired bubble pattern.

Figure 4:
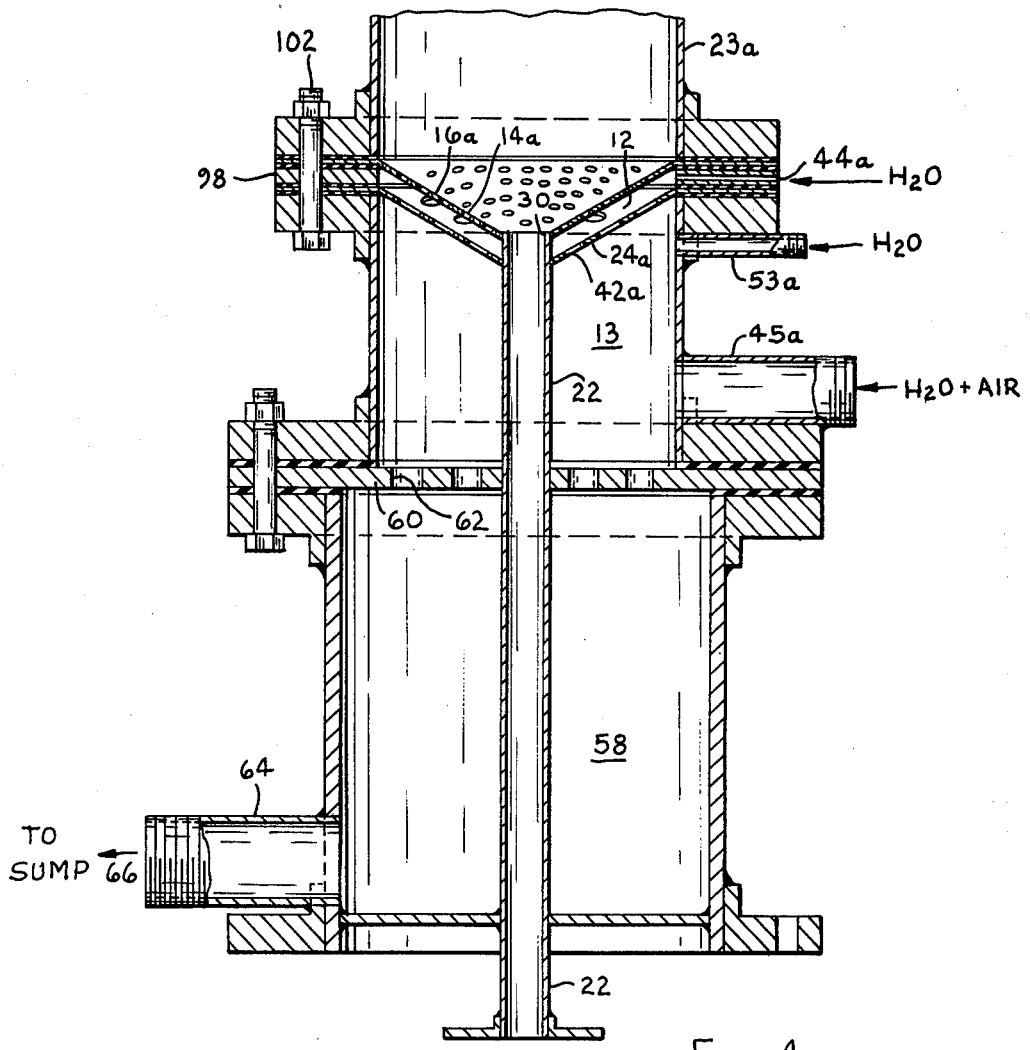
FIG. 4 is a fragmentary, sectional view of a pilot plant embodiment essentially to scale.
Figure 5:
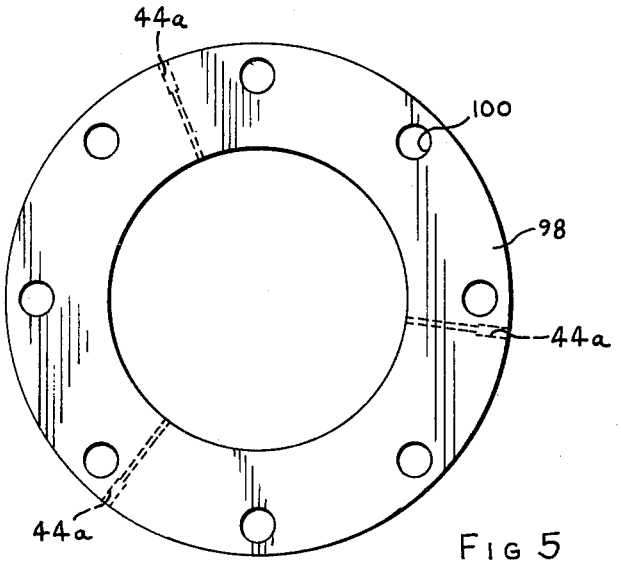
FIG. 5 is a plan view of the water ring used therein, also essentially to scale.

In FIGS. 4 and 5 is illustrated a pilot plant apparatus, like numerals indicating like parts. Only single pipe and extensions 44, 45, 46 and 47 were used. Instead of extensions 44 within compartment 12, an annular plate 98 was used having three radial passages 44*a* and holes 100 for flange bolts 102. Other dimensions for this pilot plant apparatus, given as exemplary only, are as follows:

Outside diameter of compartment 10 8.625 inches
Thickness of wall 23 0.322 inches
Height of compartment 10 15 feet
Passage 44*a* 0.25 inch I.D.
Spacing between plates 16*a* and 24*a* 0.50 inch A suitable operating procedure referring primarily to the pilot plant, is given in the following. A modified procedure may be required for a full scale model, but in general, it will be the same.

The system is initially filled with water. Float 71 is deactivated to open valve 68 fully. With pump 84 running, valves 51 are adjusted to obtain twenty-two (22) pounds per square inch (psi) on gauge 93. Adjust valve 91 to maintain water level within reservoir 66 above level 90. These adjustments maintain about seventeen (17) gallons per minute water flow through the single pipe 47 and approximately two (2) cubic feet per minute air flow through the aspirator 52.

Now level-floats 70 and 71 are activated. While observing the bubble patterns within compartment 10 through window 96, valve 49 is opened until the desired pattern of bubble movement is obtained, one suitable pattern being rising as explained previously. For one working arrangement, three (3.0) gallons per minute flow through the single pipe 46 provided satisfactory results.

Valve 93 is also opened sufficiently to achieve or assure the desired bubble pattern, a 0.7 gallon per minute flow through pipe 53 being found to be adequate in the aforesaid working arrangement. This pipe 53 and valve 93 may not be necessary for every possible size of compartment 10.

Surfactant may be introduced into the system by means of suitable pump 95 until a desired froth to aqueous pulp interface level is obtained in compartment 10. Aqueous feed pulp at a desired rate is delivered to feed well 17. The sensors 94 and 95 are activated to control valve 32 to obtain proper flow of froth overflow into launder 20. If sensors 94 and 95 are not used, valve 32 is manually controlled.

Actual dimensions and parameters may vary with each installation and with each different kind of pulp. Theoretically, compartment 12 acts as a hydraulic seal which prevents solids from entering compartment 13 from compartment 10 and further to provide water in a quantity which avoids cavitation.

Simply stated, when the system is adjusted, rising currents of bubbles will extend upwardly from plate 16 and pulp solids will be prevented from entering the water recovery system from compartment 10.

When air bubbles rise by buoyancy in a column of water, a void occurs at the lower position as the bubble goes from the lower to its upper position. When a constriction like an aperture 14 is inserted between such positions, the lower void must necessarily be filled with water from above the constriction aperture since water is essentially non-expandable.

This causes an intermittent flow of air bubbles upward through the constriction aperture and a counter flow of water downward through the aperture. Since the water in the flotation column contains solids, solids will also be drawn downward through the apertures and thus enter the water recovery system and build up a circulating load.

This phenomena is stopped by inserting a second constriction plate 24 in close proximity below the top plate 16. Openings 42 in the bottom plate 24 are larger than in the top plate to allow air to rise freely by buoyancy through the bottom constriction plate 24. Hydraulic seal water is added between the two plates under sufficient pressure so that rising air bubble voids are filled with this water.

As stated previously, chemicals may be added to the pulp in the form of reagents and surfactants. Since the water recovered and conserved via the compartment 58 contains these chemicals, they are recirculated back through the system and thereby reused. This results in a double economy in the respect of reusing the same water and chemicals.

While there have been described above the principles of this invention in connection with specific apparatus, it is to be clearly understood that this description is made only by way of example and not as a limitation to the scope of the invention.

What is claimed is:

1. Apparatus for separation of minerals from an aqueous pulp containing a mixture of mineral and gangue particles by froth flotation compising:

an upstanding flotation compartment adapted to contain a relatively quiescent body of aqueous pulp, feed means for introducing aqueous pulp into said flotation compartment, froth-collecting means disposed adjacent to the upper end of said flotation compartment for collecting a float fraction of said aqueous pulp, aeration means for applying aerated water to said flotation compartment near the bottom whereby bubbles of air are introduced throughout substantially the entire cross-section of said flotation compartment, said aeration means including a constriction plate substantially spanning said flotation compartment, said constriction plate having a plurality of bubble-receiving apertures spaced throughout the area thereof, tailing-discharge means for discharging an aqueous non-float fraction of unfloated particles of said aqueous pulp from said flotation compartment, water-collecting means below said constriction plate for receiving water from said aeration means, means for inhibiting passage of said non-float fraction from said flotation compartment to said water-collecting means, and pump means for pumping water from said water-collection means back to said aeration means, whereby the water that is collected is recirculated and aerated for application to said flotation compartment.

2. The apparatus of claim 1 including water supply means for replenishing water to said flotation compartment in an amount corresponding to the amount of water discharge from said flotation compartment which includes the discharge from said tailing-discharge means.

3. The apparatus of claim 1 wherein said water-collecting means includes a collecting compartment communicating with said aeration means, and said tailing-discharge means including a duct communicating with said flotation compartment above said aeration means and by-passing said collecting compartment.

4. The apparatus of claim 3 wherein said duct is centrally located with respect to said flotation compartment and extends through said collecting compartment.

5. The apparatus of claim 3 including valve means for controlling the flow of water from said collecting compartment to said pump means.

6. The apparatus of claim 3 wherein said aeration means includes a hydraulic compartment having said constriction plate, said hydraulic compartment having a second apertured plate spanning said flotation compartment spaced below said constriction plate.

7. The apparatus of claim 6 wherein said duct is centrally located with respect to said flotation compartment and extends through said hydraulic and collecting compartments.

8. Apparatus for separation of minerals from an aqueous pulp containing a mixture of mineral and gangue particles by froth flotation comprising:

an upstanding flotation compartment adapted to contain a relatively quiescent body of aqueous pulp, feed means for introducing aqueous pulp into said floations compartment, froth-collecting means disposed adjacent to the upper end of said flotation compartment for collecting a float fraction of said aqueous pulp, aeration means for applying aerated water to said flotation compartment near the bottom whereby bubbles of air are introduced throughout substantially the entire cross-section of said flotation compartment, tailing-discharge means for discharging an aqueous non-float fraction of unfloated particles of said aqueous pulp from said flotation compartment, water-collecting means for receiving water from said aeration means, means for inhibiting passage of non-float fraction from said flotation compartment to said water-collecting means, pump means for pumping water from said water-collecting means back to said aeration means, whereby the water that is collected is recirculated and aerated for application to said flotation compartment, water supply means for replenishing water to said flotation compartment in an amount corresponding to the amount of water discharged therefrom, said water-collecting means including a water compartment beneath and communicating with said aeration means, and said tailing-discharge means including a duct communicating with said flotation compartment above said aeration means and by-passing said water compartment, said water replenishing means further including a reservoir and a hydraulic line leading thereto from said water compartment, said reservoir having an outlet, and said pump means being connected between said outlet and said aeration means.

9. The apparatus of claim 8 including an adjustable control valve in said hydraulic line for controlling the flow of water therethrough.

10. The apparatus of claim 9 wherein said water-replenishing means includes a source of water in feeding relation to said reservoir, a water level-controlling device in said reservoir, a second control valve in series between said source and said reservoir, means interconnecting said water level-controlling device and said second valve for feeding water to said reservoir upon actuation of said level-controlling device.

11. The apparatus of claim 10 wherein said level-controlling device includes a float, said float being connected to said second valve, said float upon dropping to a first predetermined level causing said second valve to open and upon rising to a second predetermined level causing said second valve to close.

12. Apparatus for separation of minerals from an aqueous pulp containing a mixture of mineral and gangue particles by froth flotation comprising:

an upstanding flotation compartment adapted to contain a relatively quiescent body of aqueous pulp, feed means for introducing aqueous pulp into said flotation compartment, froth-collecting means disposed adjacent to the upper end of said flotation compartment for collecting a float fraction of said aqueous pulp, hydraulic means for applying water to said flotation compartment near the bottom thereof, aeration means for applying aerated water to said flotation compartment near the bottom whereby bubbles of air are introduced throughout substantially the entire cross-section thereof, tailing-discharge means for discharging an aqueous non-float fraction of unfloated particles of said aqueous pulp past said aeration means and hydraulic means, and means for adjusting the balance of water and aerated water volumes applied by said hydraulic and aeration means.

13. The apparatus of claim 12 wherein said hydraulic means includes a hydraulic compartment separated from the bottom of said flotation compartment by means of an apertured constriction plate.

14. The apparatus of claim 13 wherein said aeration means includes an aeration compartment beneath said hydraulic compartment.

15. The apparatus of claim 14 wherein said aeration compartment is separated from said hydraulic compartment by means of a second apertured constriction plate.

16. The apparatus of claim 15 wherein said hydraulic and aeration means include pipe sections in each of said hydraulic and aeration compartments and a source of water, said adjusting means including individually adjustable valves in series between said source and said pipe sections, respectively.

17. The apparatus of claim 16 including water-collecting means for receiving water from said hydraulic and aeration compartments, and pump means for pumping water from said water-collection means back to said source, whereby the water that is collected is recirculated back to said hydraulic and aeration compartments.

18. The apparatus of claim 17 including water supply means for replenishing water to said flotation compartment in an amount corresponding to the amount of water discharged from said tailing-discharge means, said water-collecting means including a water compartment beneath and communicating with said aeration means, and said tailing-discharge means including a duct communicating with said flotation compartment above said aeration means and bypassing said water compartment, said water-replenishing means further including a reservoir and a hydraulic line leading thereto from said water compartment, said reservoir having an outlet, and said pump means being connected between said outlet and said source.

19. The apparatus of claim 12 wherein said hydraulic and aeration means includes pipe sections extending into a space beneath and in communication with said flotation compartment, and said adjusting means including at least one controllable valve in series with one or more of said pipe sections.

20. The apparatus of claim 19 wherein said hydraulic and aeration means include water source means for supplying pressurized water to said pipe sections, said valve being connected to said source means.

21. The apparatus of claim 20 wherein said source means includes a manifold, said pipe sections being connected to said manifold and having control valves in series therewith, respectively.

22. The method of separating minerals from an aqueous pulp containing a mixture of mineral and gangue particles by froth flotation comprising the steps of providing a quantity of water within a compartment, feeding aqueous pulp containing a mixture of water and particles to be connected into the upper region of said compartment, discharging a mixture of water and non-float fraction of said pulp from the lower region of said compartment, controlling the rate of discharge to correspond to the rate of water as contained in the aqueous pulp fed to said compartment, supplying aerated water to the lower region of said compartment for providing a supply of levitating air bubbles and froth for floating the float fraction of said aqueous pulp, collecting froth containing float fraction from the water in said compartment, collecting water from said compartment from a location beneath that at which aerated water is supplied, introducing a hydraulic seal at a location above that at which said water is collected for inhibiting non-float fraction for being included in said collected water, recirculating said collected water to said compartment, and aerating at least a portion of such recirculated water.

23. The method of claim 22 wherein said step of controlling discharge further includes maintaining the water in said compartment at a predetermined level.

24. The method of claim 23 including the step of adding water from an external source to said compartment by introducing it along with said recirculated water.

25. The method of claim 23 including discharging said mixture of water and non-float fraction from a position above that at which aerated water is so supplied.

26. Apparatus for separation of minerals from an aqueous pulp containing a mixture of mineral and gangue particles by froth flotation comprising:

an upstanding flotation compartment adapted to contain a relatively quiescent body of aqueous pulp, feeding means for introducing aqueous pulp into said flotation compartment, froth-collecting means disposed adjacent to the upper end of said flotation compartment for collecting a float fraction of said aqueous pulp, aeration means for applying aerated water to said flotation compartment near the bottom whereby bubbles of air are introduced throughout substantially the entire cross-section thereof, tailing-discharge means for discharging an aqueous non-float fraction of unfloated particles of said aqueous pulp past said aeration means, means for collecting water from said flotation compartment at a location beneath said aeration means and recirculating it back to said flotation compartment, and means supplying non-aerated water to said aeration means and to the bottom portion of said flotation compartment for inhibiting the gravitating passage therethrough and to said water-collecting means of aqueous non-float fraction.

27. The apparatus of claim 26 wherein said aeration means includes two vertically spaced apertured plates spanning said flotation compartment and means for introducing aerated water therebeneath whereby bubbles levitate through the apertures in said plate, and said non-aerated water supply means including first means for introducing said non-aerated water into the space between said plates.

28. The apparatus of claim 27 including second means for introducing additional non-aerated water beneath said plates.

29. The apparatus of claim 28 including means for replenishing water to said flotation compartment as lost therefrom by adding it to said recirculating means.

30. The apparatus of claim 29 including means for adjusting the rate of flow of aerated and non-aerated water into said flotation compartment, to and between said plates.

31. The apparatus of claim 28 wherein the apertures in the lower of said plates are larger than the apertures in the upper thereof and the non-aerated water admitted to the space therebetween is in such quantity to serve as a hydraulic seal against aqueous non-float fraction from passing to said water-collecting means.

* * * * *

UNITED STATES PATENT AND TRADEMARK OFFICE

CERTIFICATE OF CORRECTION

PATENT NO. : 4,394,258
DATED : July 19, 1983
INVENTOR(S) : Donald E. Zipperian

It is certified that error appears in the above—identified patent and that said Letters Patent is hereby corrected as shown below:

Col. 3, line 51, change "7490" to --7400--.

Col. 12, line 25, change "feeding" to --feed--.

Signed and Sealed this

*Fourteenth* Day of *February 1984*

[SEAL]

*Attest:*

GERALD J. MOSSINGHOFF

*Attesting Officer*

*Commissioner of Patents and Trademarks*